US008702276B2

(12) United States Patent
Christoffersen

(10) Patent No.: US 8,702,276 B2
(45) Date of Patent: Apr. 22, 2014

(54) ILLUMINATION DEVICE WITH SPLIT BEAM EFFECT

(75) Inventor: Peter Skytte Christoffersen, Brabrand (DK)

(73) Assignee: Martin Professional A/S, Aarhus N. (DK)

( * ) Notice: Subject to any disclaimer, the term of this patent is extended or adjusted under 35 U.S.C. 154(b) by 0 days.

(21) Appl. No.: 13/822,037

(22) PCT Filed: Sep. 8, 2011

(86) PCT No.: PCT/DK2011/050333

§ 371 (c)(1),
(2), (4) Date: Jun. 28, 2013

(87) PCT Pub. No.: WO2012/031598

PCT Pub. Date: Mar. 15, 2012

(65) Prior Publication Data

US 2013/0265756 A1 Oct. 10, 2013

(30) Foreign Application Priority Data

Sep. 10, 2010 (DK) ..... 2010 00809

(51) Int. Cl.
*F21V 17/02* (2006.01)
*F21V 9/00* (2006.01)

(52) U.S. Cl.
USPC ..... 362/283; 362/268; 362/293

(58) Field of Classification Search
USPC ..... 362/282, 283, 284, 293, 268
See application file for complete search history.

(56) References Cited

U.S. PATENT DOCUMENTS

| | | | | |
|---|---|---|---|---|
| 5,349,591 | A * | 9/1994 | Weston et al. | 372/25 |
| 5,905,571 | A * | 5/1999 | Butler et al. | 356/328 |
| 6,792,028 | B2 * | 9/2004 | Cook et al. | 372/102 |
| 7,095,560 | B2 * | 8/2006 | Toyoda et al. | 359/558 |
| 7,887,219 | B2 * | 2/2011 | Belliveau et al. | 362/268 |
| 2002/0085276 | A1 * | 7/2002 | Tanitsu et al. | 359/432 |
| 2010/0103677 | A1 | 4/2010 | Belliveau et al. | |

FOREIGN PATENT DOCUMENTS

| | | |
|---|---|---|
| JP | 2006164743 | 6/2006 |
| JP | 2008103300 | 5/2008 |
| JP | 2009501418 | 1/2009 |
| WO | WO2005/010433 | 2/2005 |
| WO | WO2007/007271 | 1/2007 |

OTHER PUBLICATIONS

International Search Report; International Application No. PCT/DK2011/05033; International Filing Date: Sep. 8, 2011; 8 pages.

(Continued)

*Primary Examiner* — Peggy A. Neils
(74) *Attorney, Agent, or Firm* — Blank Rome LLP

(57) ABSTRACT

The present invention relates to an illumination device comprising at least one light source generating a light beam and at least one light beam diffractor. The light diffractor is positioned at least partially in the light beam and adapted to diffract at least a part of the light beam. The light beam diffractor includes a first diffractor section and a second diffractor section which can be moved in relation to the light beam and independently of each other. The present invention relates also to moving head light fixtures and method of forming a light beam.

9 Claims, 7 Drawing Sheets

(56) References Cited

OTHER PUBLICATIONS

International Written Opinion; International Application No. PCT/DK2011/05033; International Filing Date: Sep. 8, 2011; 10 pages.
First Office Action; Japanese Patent Application No. JP2013526316; Aug. 20, 2013; 8 pages.
English abstract; Japanese Patent Application No. JP2006164743; 1 page.
English abstract; Japanese Patent Application No. JP2008103300; 1 page.
English abstract; Japanese Patent Application No. JP2009501418; 1 page.

* cited by examiner

ILLUMINATION DEVICE WITH SPLIT BEAM EFFECT

FIELD OF THE INVENTION

The present invention relates to an illumination device comprising at least one light source generating a light beam and at least one light beam diffractor, where the light diffractor is positioned at least partially in the light beam and adapted to diffract at least a part of the light beam. The present invention relates also to moving head light fixtures typically used in entertainment lighting.

BACKGROUND OF THE INVENTION

Light fixtures creating various effects are getting more and more used in the entertainment industry in order to create various light effects and mood lighting in connection with live shows, TV shows, sport events and/or as a part of architectural installation. Typically entertainment light fixtures create a light beam having a beam width and a divergence and can for instance be wash/flood fixtures creating a relatively wide light beam with a uniform light distribution with a soft edge or it can be profile fixtures adapted to project images onto a target surface. It is common to incorporate mid air light effects into light shows. Mid air effects are created by creating a well-defined light beam which is partially scattered by haze or smoke particle in the air whereby the audience can see the light beam in the air. The mid air light beams are often created in the head of a moving head light fixture where the head is rotatably connected to a yoke which is rotatably connected to a base and the light beam can as a consequence be moved around in the air. Today there are a number of different products (e.g. The MAC 250 Beam™ or the MAC 2000 Beam™ provided by Martin Professional A/S) which are capable of providing such light beams and many of these can create light beams with variable beam divergence and/or collimated light beams having variable beam diameter.

US2010/0103677 discloses a theatre lighting apparatus comprising a base, a communications port, a processor, a memory, and a lamp housing. The lamp housing includes a lamp, a reflector, an output lens, a motor, and a homogenizing lens. The homogenizing lens comprises a plurality of radically arranged lenticular lenses, and a processor programmed to enable a motor to vary a position of the homogenizing lens in relation to a position of the output lens. The homogenizing lens may be comprised of a first half and a second half, each of which may have a plurality of radically arranged lenticular lenses. The lightning apparatus comprises also a prism apparatus positioned between the light source and the output lens. The prism apparatus is constructed of a plurality of prisms mounted to a substrate. In operation, incoming light rays pass through the substrate and through the base of each prism where a first portion of light rays is refracted into a first direction exiting from one side of the prisms, and a second portion of light rays is refracted into a second direction exiting from another side of the prism. The prism apparatus is attached to a rotation motor capable of rotating the prism apparatus about its center, and the prism apparatus and rotation motor are attached to a lead screw and driving motor so the prism apparatus can be transitioned into a light beam. The combination of the prism apparatus and a polymer fresnel front lens results in two substantially separate exiting beams of light (referred to as twin beams). The prism apparatus is also connected to a displacement motor capable of displacing the prism apparatus in relation to the front lens. The angular deviation of the two separate beams of light can hereby be controlled. The twin beams are dependent on each other, since they primarily are created by the prism apparatus and the characteristics (e.g. intensity, color, divergence, size) of the twin beam can thus substantially the same and cannot be controlled independently.

DESCRIPTION OF THE INVENTION

The object of the present invention is to solve the above described limitations related to prior art. This is achieved by an illumination device, a light fixture and a method as described in the independent claims. The dependent claims describe possible embodiments of the present invention. The advantages and benefits of the present invention are described in the detailed description of the invention.

DETAILED DESCRIPTION OF THE INVENTION

The present invention is described in view of the accompanying drawing. The person skilled in the art will realize that the drawings are illustrating the principles behind the present invention and do not serve as detailed specifications showing final embodiments. The illumination device when carried out may thus differ from the illustrated embodiments and may also comprise further components.

Figure 1A:
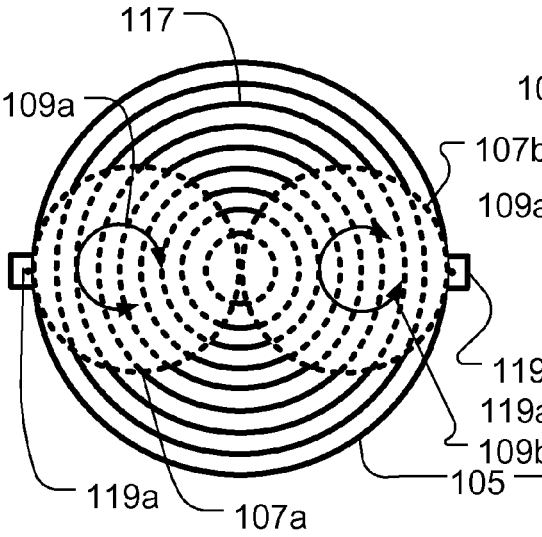
FIGS. 1*a*-1*d* illustrate a first embodiment of the illumination device according to the present invention.
Figure 1C:
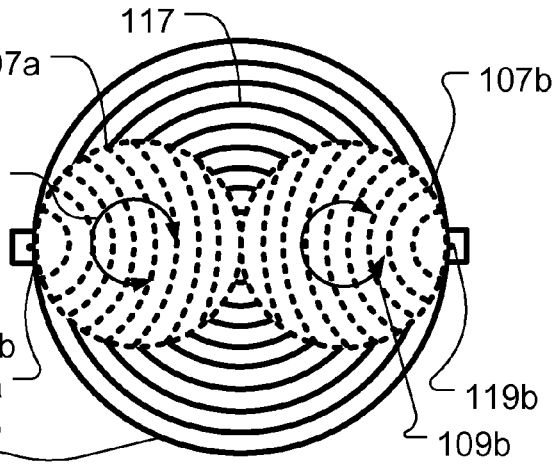
Figure 1B:
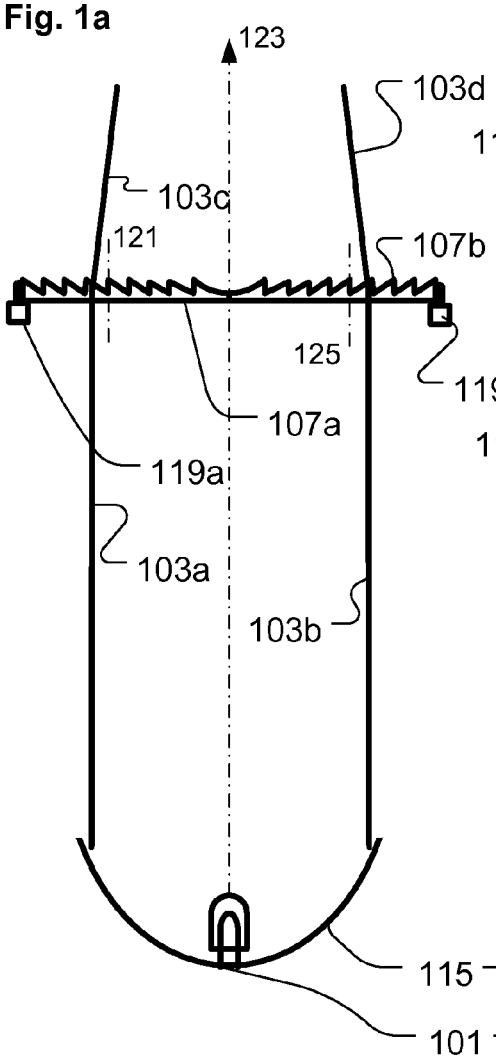
Figure 1D:
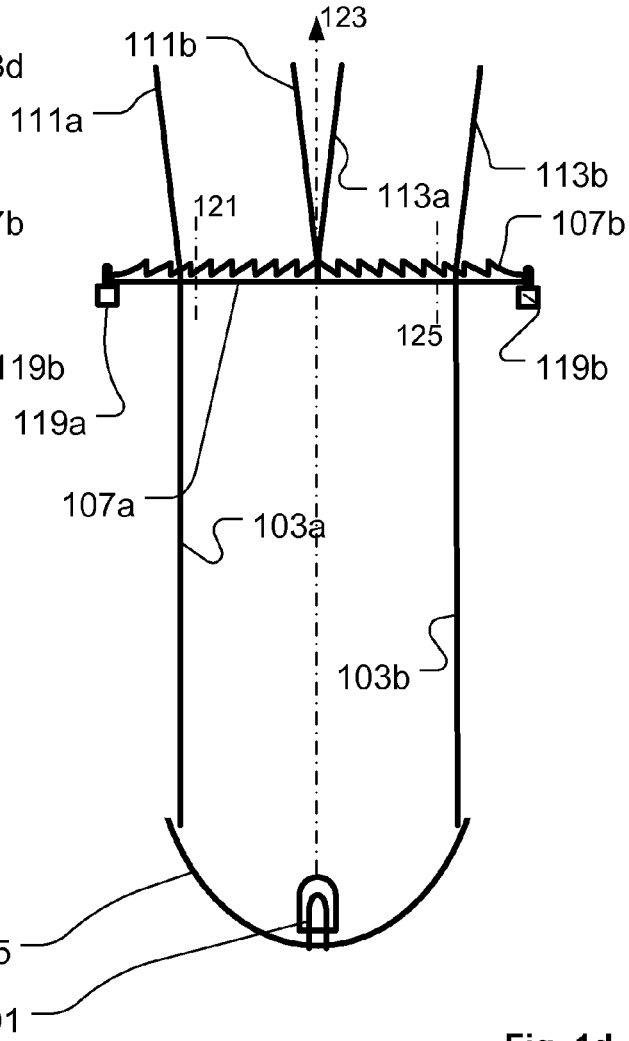

FIGS. 1*a*-1*d* illustrate a first embodiment of the illumination device according to the present invention. FIGS. 1*a* and 1*b* illustrate respectively a top view and a cross sectional view of the illumination device in a first setting and FIGS. 1*c* and 1*d* illustrate respectively a top view and cross sectional view of the illumination device in a second setting.

The illumination device comprises a light source 101 generating a light beam and a light beam diffractor 105 positioned in and adapted to diffract the light beam. The light beam generated by the light source is illustrated by lines 103*a* and 103*b* indicating the boundaries of the light beam, and lines 103*c* and 103*d* indicate the boundaries of the light beam diffracted by the light beam diffractor 105.

The light beam diffractor 105 comprises a first diffractor section 107*a* (in dotted lines) diffracting a first part of the light beam and a second diffractor section 107*b* (in dotted lines) diffracting a second part of the light beam. The first diffractor section 107*a* and the second diffractor section 107*b* are movable independently of each other and in relation to the light beam.

Arrow 109*a* indicates that the first diffractor section 107*a* is movable in relation to the light beam through rotation, and in the second setting illustrated as can be seen in FIG. 1*c* the first diffractor section 107*a* is rotated approximately 180 degrees in relation to its position in the first setting in FIG. 1*a*. The consequence is that the first diffractor section 107*a* diffract the first part of the light beam in a first direction in the first setting and in a second direction in the setting. The second direction of the first light beam is illustrated in FIG. 1*d* by lines 111*a* and 111*b* indicating the boundaries of the first part of the light beam after it has been deflected by the first diffractor section 107*a*.

Similarly arrow 109*b* indicates that the second diffractor section 107*b* is movable in relation to the light beam through rotation, and in the second setting illustrated in FIG. 1*c* the second diffractor section 107*b* is rotated approximately 180 degrees in relation to the first setting illustrated in FIG. 1*a*. The consequence is that the second diffractor section 107*b* diffract the second part of the light beam in a first direction in the first setting and in a second direction in the second setting. The second direction of the second light beam is illustrated in FIG. 1*d* by lines 113*a* and 113*b* indicating the boundaries of the second part of the light beam after it has been deflected by the second diffractor section 107*b*.

The consequence is that it is possible to create two independently controlled light beams by moving the first 107*a* and second diffractor sections 107*b* independently of each other. This creates a new and exciting light effect as the direction of the two light beams can be controlled independently of each other and can also be combined into one single light beam as in FIG. 1*b*. In the illustrated embodiment the two independently controlled light beams will perform a circular and cone like movement.

The light source 101 is illustrated as a discharge lamp positioned in a reflector 115 where the reflector is adapted to form the light beam as known in the art. A skilled person can design a diverging, converging or collimated (as illustrated) light beam depending on the desired optical properties of the system. The skilled person realizes that any type of light source (e.g LED, OLED, plasma sources etc.) capable of generating a light beam can be used. The illustrated light source can for instance be replaced by an LED co-operating with a TIR-lens where the TIR-lens collects light and forms the light beam. The light source can also be embodied as a number of light sources where the light beam is formed by collecting/integrating light from a number of light sources e.g. a number of LED positioned in an array.

The light beam diffractor 105 is illustrated as a Fresnel lens where the first diffractor section 107*a* and the second diffractor section are embodied as circular cutouts in the Fresnel lens. The illustrated circle 117 indicates the edges of the Fresnel zones and it can be seen that the Fresnel zones of the first and second diffractor sections can be rotated. The parts of the front lens that do not constitute the first and second diffractor sections can in one embodiment be covered by a nontransparent material whereby light only exits through the first and section diffractor sections whereby two clearly distinct light beams are created (second setting of FIGS. 1*c* and 1*d*). The independent light beams can also be combined into a common light beam as if the front lens were a normal Fresnel lens (first setting of FIGS. 1*a* and 1*b*). The skilled person realizes the parts of the front lens that do not constitute the first and second diffractor sections also can be removed instead and replaced by a cover as an alternative to covering these parts with a nontransparent material.

On the other hand the parts of Fresnel lens that do not constitute the first and second diffractor can also be transparent whereby a stationary central light beam part is created and where two independently controllable light beam can be adapted to move in relation to the central light beam. This will result in exciting mid air effects and can also provide a new zoom technique as the two controllable light beams can be used to provide a wider beam when they are directed outward in relation to the central beam.

The skilled person realizes that the light beam diffractor alternatively can be a regular diffracting optical components like lenses, reflectors, prisms where the diffractor sections have been created as smaller parts which can be moved independently of each other.

The illumination device comprises also a first actuator 119*a* adapted to move the first diffractor section 107*a* in relation to the light beam. In the illustrated embodiment the first actuator is adapted to rotate the first diffractor section 107*a* around a first axis 121 which is substantially parallel with the central axis 123 of the light beam. Similarly a second actuator 119*b* is adapted to move the second diffractor section 107*b* in relation to the light beam and can rotate the second diffractor section 107*b* around a second axis 125 which is substantially parallel with the central axis 123 of the light beam. The actuators are in the illustrated embodiment adapted to interact with the outer perimeter of the diffractor sections and can hereby rotate each diffractor section. The first actuator and the second actuator can be independently controlled by at least one processor (not shown).

Figure 2A:
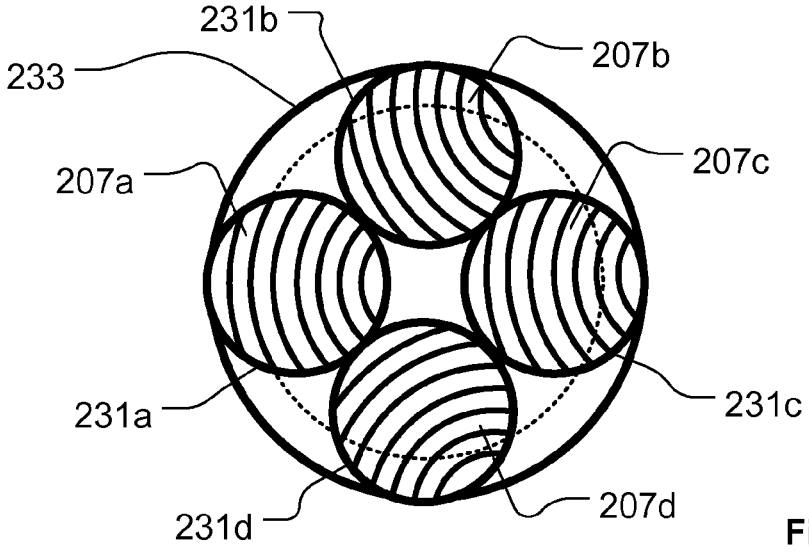
FIGS. 2*a*-2*b* illustrate a second embodiment of the illumination device according to the present invention.
Figure 2B:
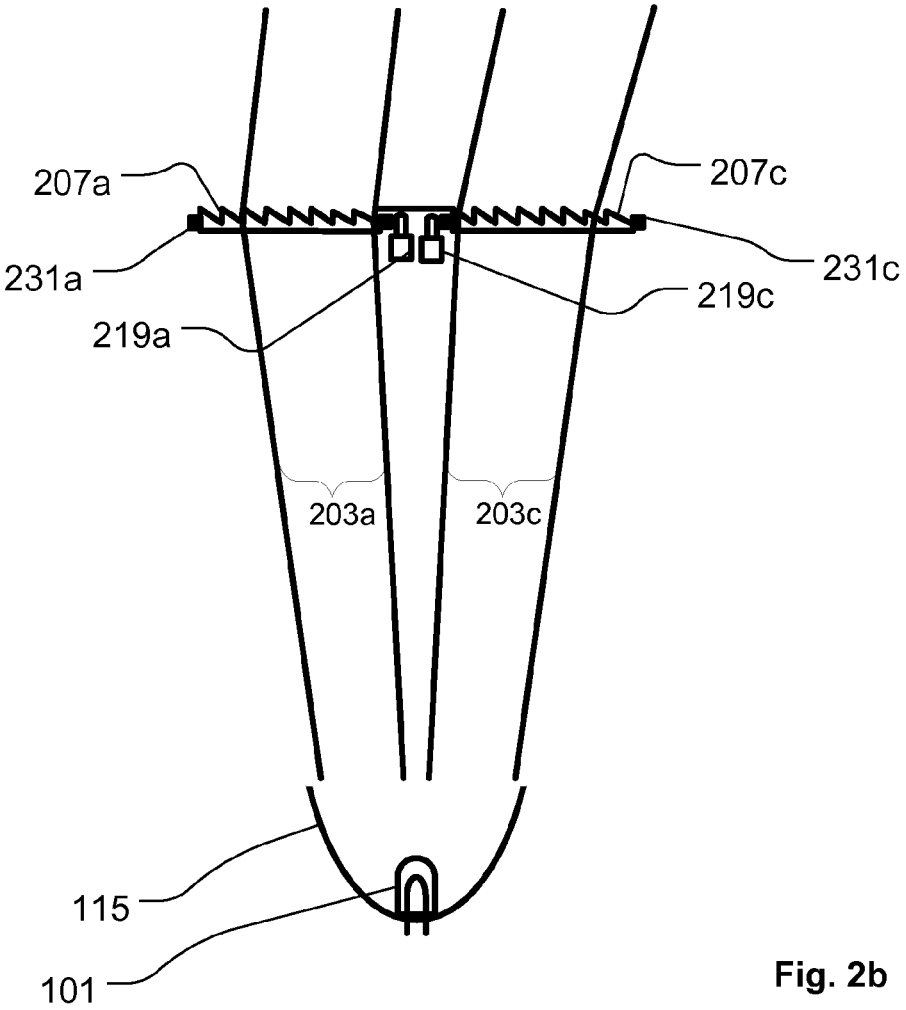

FIGS. 2*a* and 2*b* illustrate another embodiment of the illumination device according to the present invention, where FIG. 2*a* illustrates a top view and FIG. 2*b* illustrates a cross sectional view. In this embodiment the light beam diffractor comprises four diffractor sections 207*a-d* which can be rotated in relation to the light beam by four actuators (only two illustrated as 219*a*, 219*c*). The actuators can be controlled independently of each other and the four diffractor sections can thus also be rotated independently of each other. The diffractor sections 207*a*-207*d* are like in FIG. 1*a*-1*b* embodied as circular cutouts of a Fresnel lens. The diffractor sections are mounted in bearings (231*a*-231*c*) which are mounted in a front plate 233. The outer perimeter interact with the actuators (only actuator 219*a* and 219*c* illustrated) e.g. through a gear mechanism. The bearings provide a smooth rotation and reduce wear. The light beam is in this embodiment optimized such that the amount of light hitting the four diffractor sections are as large as possible. In the top view this is illustrated by the dotted line 235 indicating the outer perimeter of the incoming light beam. The cross section view FIG. 2*b* illustrates only the light beam parts 203*a* and 203*c* which respectively passes through the diffractor section 207*a* and 207*c* and it can be seen that these are placed in a setting where the two light beam parts are diffracted in substantially the same direction. In this embodiment the actuators are positioned below the central part of front plate.

Figure 3A:
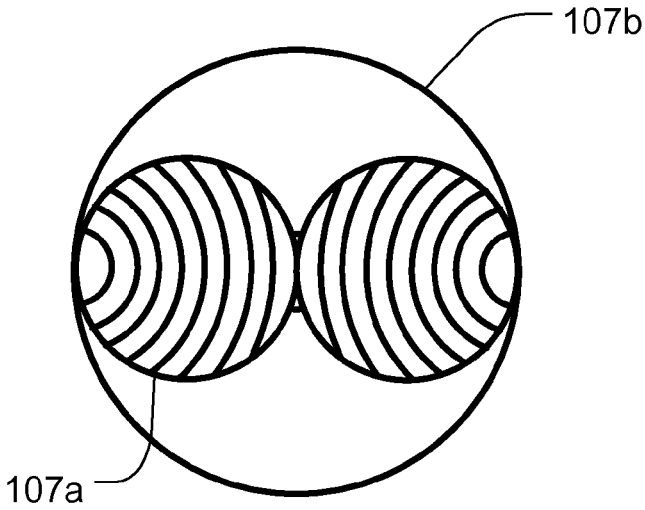
FIGS. 3*a*-3*b* illustrate a third embodiment of the illumination device according to the present invention.
Figure 3B:
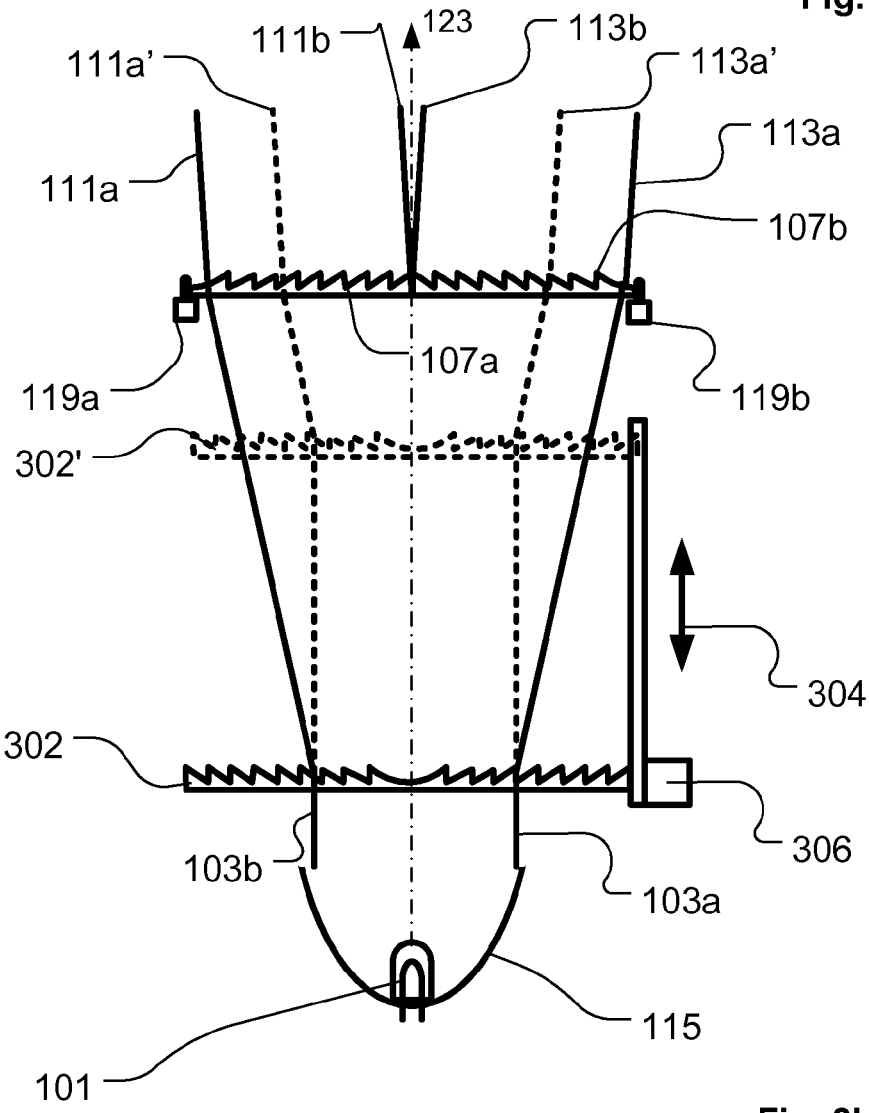

FIGS. 3*a* and 3*b* illustrate an embodiment similar to the embodiment of FIGS. 1*a*-1*d*. The illumination device is here illustrated in second setting like in FIGS. 1*c* and 1*d*. In this embodiment the illumination device comprises a zoom lens 302 which is positioned in the light beam and between the light source 101 and the light beam diffractor 105. The zoom lens diffracts the light beam and can be moved along (indicated by arrow 304) the central axis 123 of the light beam by an actuator 306.

The zoom lens 302 is illustrated (in solid lines) in a first position close to the light source. The light beam will in this position be diffracted by the zoom lens 302 and is adapted to hit most of the part of the light diffractor whereby the width of the two light beams created by the first and second diffractor section is large. The zoom lens 302' is also illustrated (in dotted lines) in a second position close to the light beam diffractor 105 and the light beam deflected by the zoom lens will hit a smaller portion of the light beam diffract 105 and the first and second diffractor sections will create smaller light beams as indicated by 111*a*' and 113*a*'. This creates a way of generating the independently controlled light beams and the person skilled in optics can design the divergence and width of the outcoming light beams by regulating the optical power of the zoom lens and light beam diffractor.

Figure 4A:
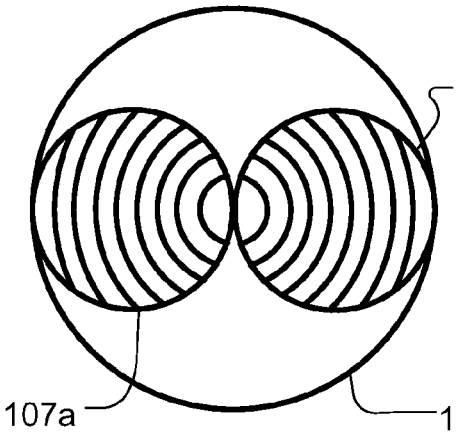
FIGS. 4*a*-4*d* illustrate a fourth embodiment of the illumination device according to the present invention.
Figure 4C:
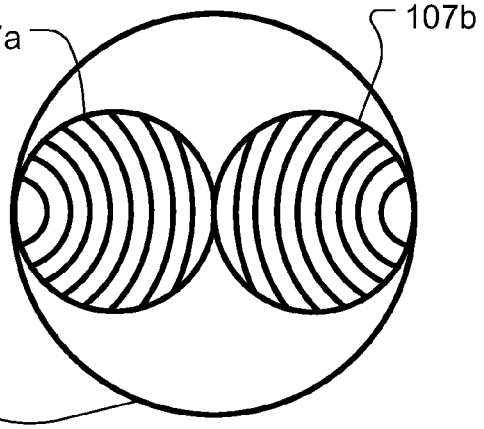
Figure 4B:
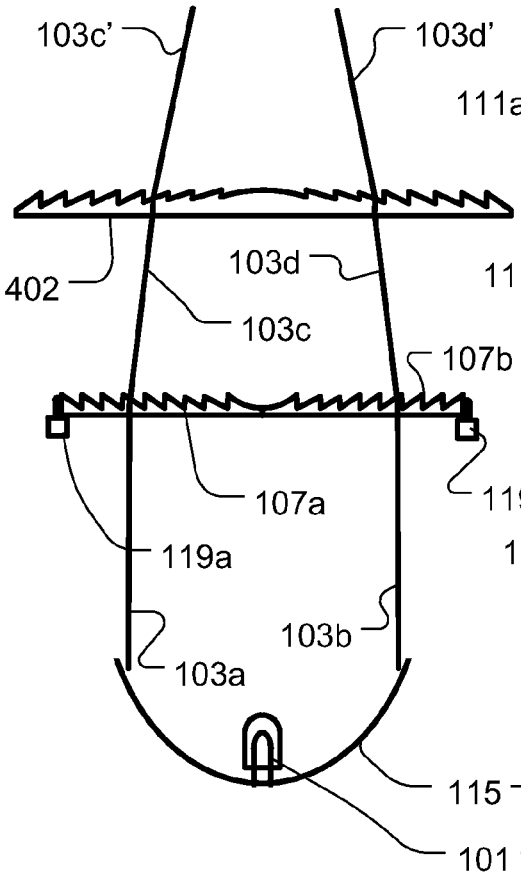
Figure 4D:
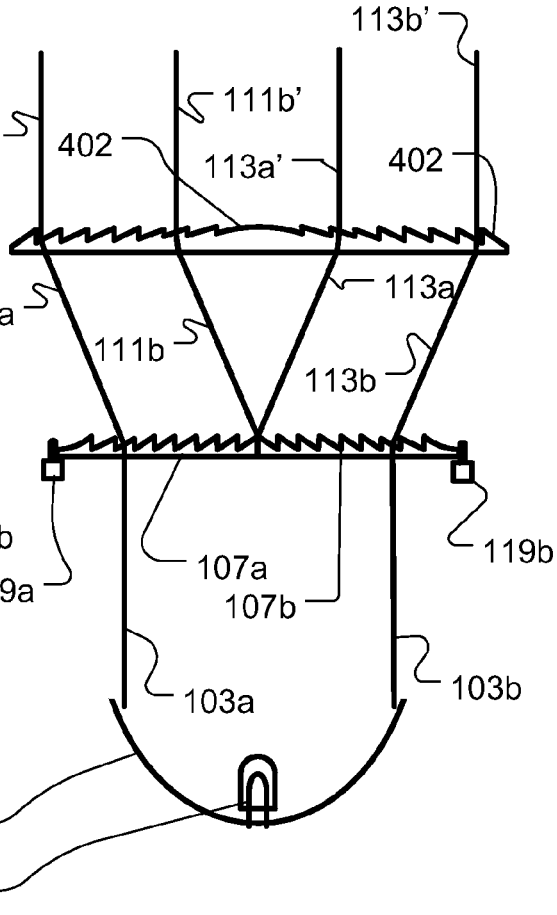

FIGS. 4*a*-4*d* illustrate an embodiment similar to the embodiment of FIGS. 1*a*-1*d*. FIGS. 4*a* and 4*b* illustrate respectively a top view of the light beam diffractor 105 and a cross sectional view of the illumination device in a first setting. FIGS. 4*c* and 4*d* illustrate respectively a top view of the light beam diffractor 105 and cross sectional view of the illumination device in a second setting. In this embodiment the illumination device comprises a front lens 402 which is positioned in the light beam and after the light beam has passed the light beam diffractor 105. The front lens 402 diffracts the light beams leaving the light beam diffractor 103*c*/103*d*, 111*a*/111*b* and 113*a*/113*b* and results in the outgoing light beams 103*c*'/103*d*', 111*a*'/111*b*' and 113*a*'/113*b*'. This creates an alternative way of generating the independently controlled light beams and the person skilled in optics can design the divergence and width of the out coming light beams by regulating the optical power of the front lens and light beam diffract. Both the front lens 402 and light beam diffractor 105 can in other embodiments be movable along the light beam like the zoom lens illustrated in FIGS. 3*a*-3*b* in order to create various light effects.

Figure 5:
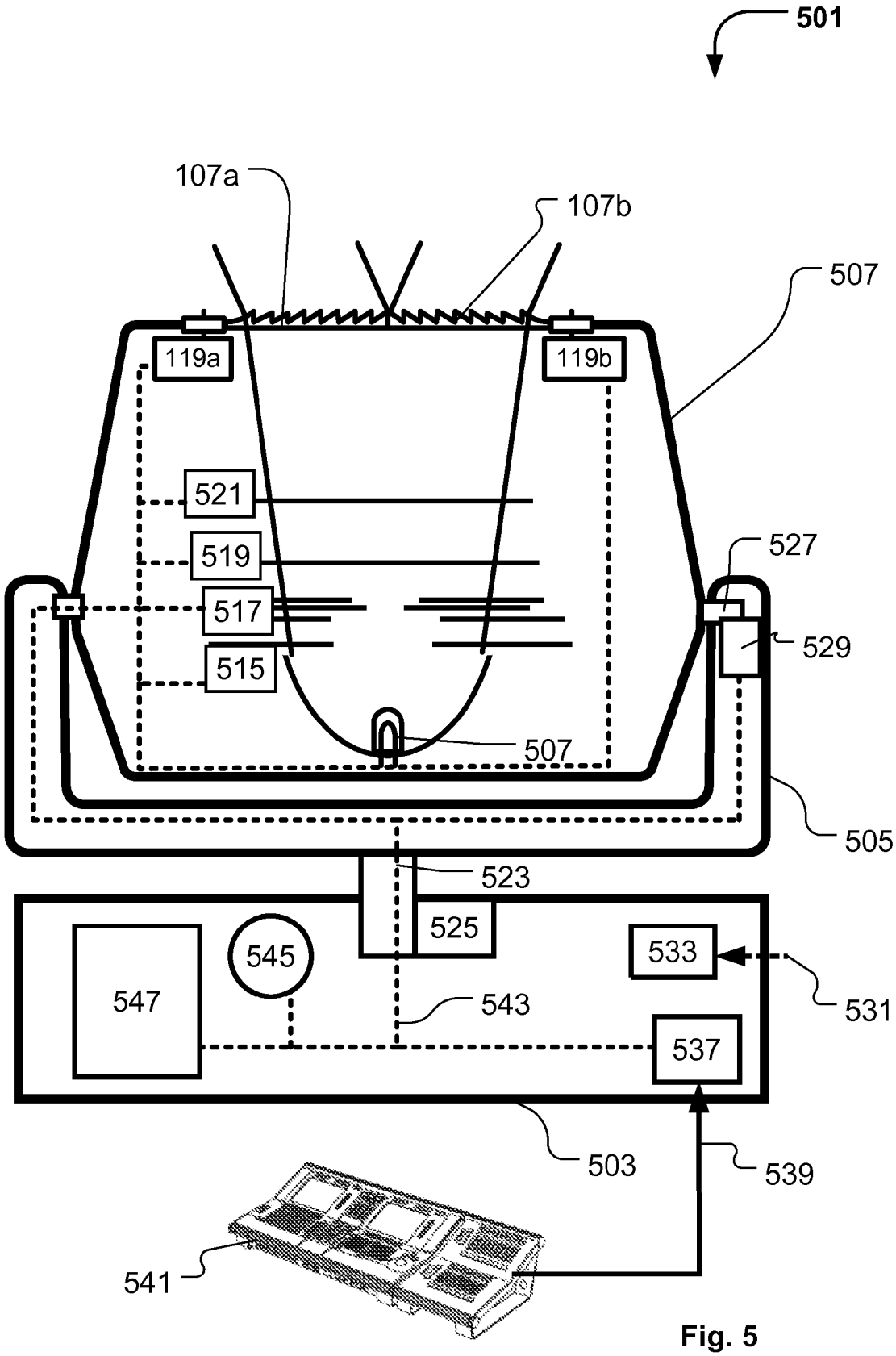
FIG. 5 illustrates a moving head light fixture comprising an illumination device according to the present invention.

FIG. 5 is a structural diagram illustrating a moving head light fixture 501 with an illumination device according to the present invention. The moving head light fixture 501 comprises a base 503 connected to a yoke 505 and a head 507 carried in the yoke. The illumination device is similar to the illumination device illustrated in FIGS. 1*a*-1*d* and comprises a light source 101 generating a light beam and a light beam diffractor positioned in and adapted to diffract the light beam. The light beam diffractor comprises a first diffractor section 107*a* diffracting a first part of the light beam and a second diffractor section 107*b* diffracting a second part of the light beam. The first diffractor section 107*a* and the second diffractor section 107*b* is movable independently of each other and in relation to the light beam. A first actuator 119*a* is adapted to rotate the first diffractor section 107*a* in relation to the light beam and a second actuator 119*b* is adapted to rotate the second diffractor section 107*b* in relation to the light beam.

A number of light effects are positioned in the light beam and can be any light effects known in the art of intelligent lighting for instance a dimmer 515, a CMY color mixing system 517, color filters 519, gobos 521, iris (not shown), prisms (not shown) etc.

The moving head light fixture comprises a first rotating means for rotating the yoke in relation to the base, for instance by rotating a shaft 523 connected to the yoke by using a motor 525 positioned in the base. The moving head light fixture comprises also a second rotating means for rotating the head in relation to the yoke, for instance by rotating a shaft 527 connected to the head by using a motor 829 positioned in the yoke. The skilled person realizes that the rotation means can be constructed in many different ways using mechanical components such as motors, shafts, gears, cables, chains, transmission systems etc.

The moving head light fixture receives electrical power 531 from an external power supply (not shown). The electrical power is received by an internal power supply 533 which adapts and distributes electrical power through internal power lines (not shown) to the subsystems of the moving head. The internal power system can be constructed in many different ways, for instance, as one system where all subsystems are connected to the same power line. However the skilled person realized that some of the subsystems in the moving head need different kind of power and that a ground line also can be included. The light source will for instance in most applications need a different kind of power than step motors and driver circuits.

The light fixture comprises also a controller 537 which controls the other components (other subsystems) in the light fixture based on an input signal 539 indicative of at least one light effect parameter and at least one position parameter. The controller receives the input signal from a light controller 541 as known in the art of intelligent and entertainment lighting, for instance, by using a standard protocol like DMX, ArtNET, RDM etc. The light effect parameter is indicative of at least one light effect parameter of said light beam for instance the amount of dimming and/or the dimming speed of the light beam, a color that the CMY system 517 should mix, the kind of color filter that a color filter system 519 should position in the light beam and/or the kind of gobo that the gobo system 821 should position in the light beam, etc. The light effect parameter can also be indicative of how the first diffractor section 107*a* should be moved in relation to the light beam, whereby the moving head light fixture is capable of controlling the direction of the light beam created by the first diffractor section 107*a*. Similarly the light effect parameter can also be indicative of how the second diffractor section 107*b* should be moved in relation to the light beam. The controller can control the position of the first and/or second diffractor sections through the actuators 119*a*, 119*b* and by instructing the actuators to move in the wanted pattern. The controller is adapted to send commands and instructions to the different subsystems of the moving head through internal communication lines 543 (in dotted lines). The internal communication system can be based on a various type of communications networks/systems and the illustrated communication system is just one illustrating example.

The position parameter is indicative of rotation of at least the yoke in relation to the base and/or rotation of the head in relation to the yoke. The position parameter can for instance indicate a position whereto the light fixture should direct the beam, the position of the yoke in relation to the base, the position of the head in relation to the yoke, the distance/angle that the yoke should be turned in relation to the base, the distance/angle that the head should be turned in relation to the base etc. The rotation parameter can also indicate the speed and time of the rotation.

The moving head can also have user input means enabling a user to interact directly with the moving head instead of using a light controller 541 to communicate with the moving head. The user input means 545 can for instance be bottoms, joysticks, touch pads, keyboard, mouse etc. The user input means could also be supported by a display 547 enabling the user to interact with the moving head through menu system shown on the display using the user input means 547. The display device and user input means can in one embodiment also be integrated as a touch screen. The illumination system can be embodied in a light effect system for forming a light beam as described in the applicants' pending patent applications PCT/DK2010/050230 published as WO 2011/029449 and are incorporated herein by reference.

The light effect system according to WO 2011/029449 comprises a base support rotatably supporting a light effect support, said light effect support comprises:

light forming means, said light forming means being adapted to form at least a part of said light beam;

at least one actuator adapted to move said light forming means in relation to said light beam;

The light effect system comprises rotatable electric connecting means, said rotatable electric connecting means enable transferring of electric energy between said light effect support and said base support during rotation of said light effect support in relation to said base support.

The illumination device can be integrated into this light effect system by positioning the diffractor sections and their actuators at the light effect support. The result is that the independently controlled light beams also can be rotated continuously/endless 60 degrees around the light beam which provides further effects.

Figure 6:
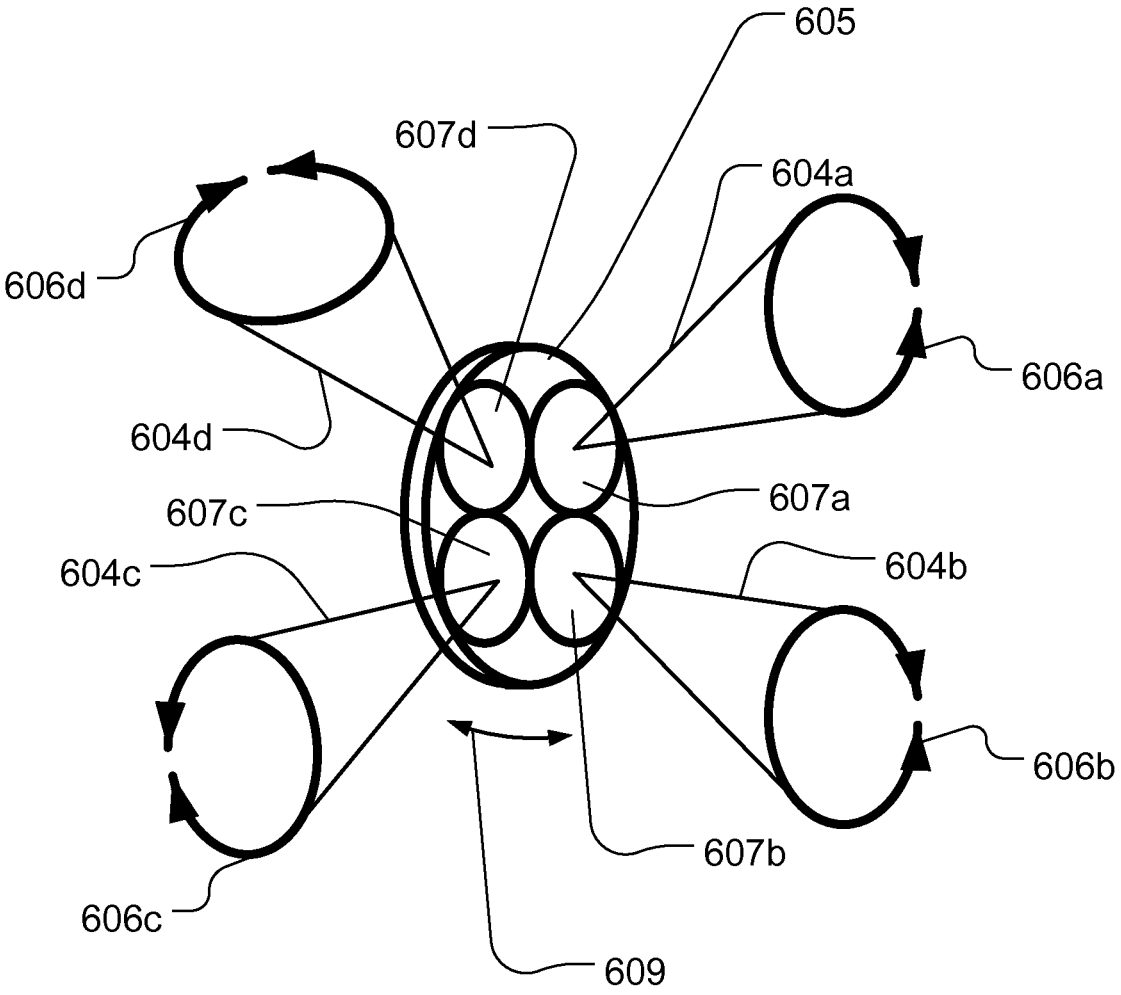
FIG. 6 illustrates a simple perspective view of a light diffractor of an illumination device according to the present invention.

FIG. 6 illustrates a simple perspective view a light diffractor 605 of an illumination device similar to the one illustrated in FIGS. 2*a* and 2*b*. The light diffractor 605 comprises four diffractor sections 607*a-d* which can be moved in relation to an in comming light beam (not shown) and independently of each other as described above. Each of the diffractor section 607*a-d* creates an independently controllable light beam 604*a-d* by diffracting the parts of the incoming light beam. The independently controllable light beams will move in a circular and cone like pattern (illustrated by arrows 606*a-d*) when the corresponding diffractor section is rotated around an axis parallel to the central axis incoming light beam. This system can as described above be embodied in light system according WO 2011/029449 which will result in the fact that all light beams further can be rotated around a common central axis as illustrated by arrow 608.

Figure 7A:
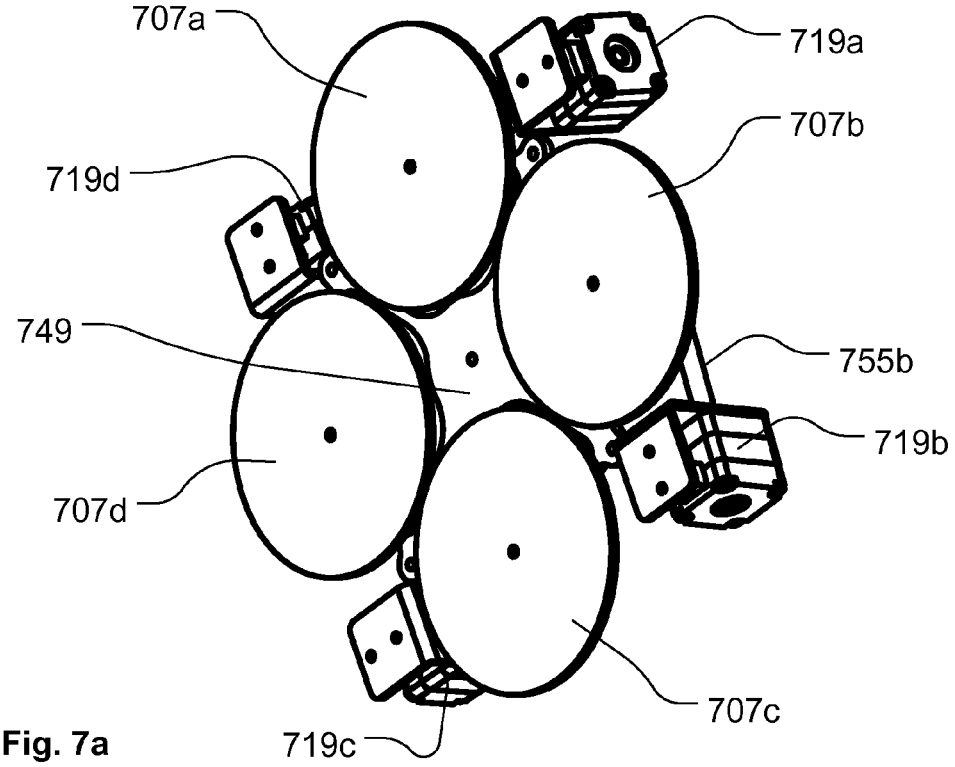
FIGS. 7*a* and 7*b* illustrate a possible embodiment of the light diffractor according to the present invention
Figure 7B:
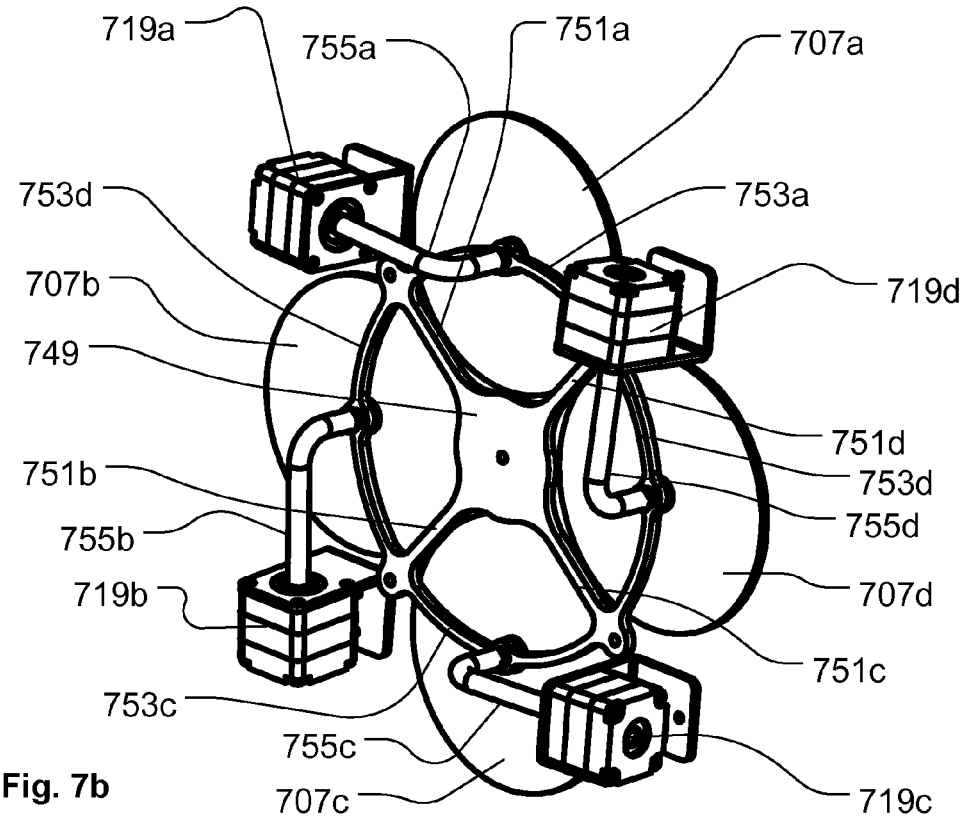

FIGS. 7*a* and 7*b* illustrate another embodiment of the illumination device according to the present invention, where FIG. 7*a* illustrates a top perspective view and FIG. 7*b* bottom perspective view. In this embodiment the light beam diffractor comprises four diffractor sections 707*a-d* which can be rotated in relation to the light beam by four actuators 719*a-d*. The illumination device comprises a mounting bracket 749 comprising a number of radial protrusions 751*a*-751*d* connected by a number of peripheral connectors 753*a*-753*d*. The diffractor sections 707*a-d* are respectively rotatably connected to the peripheral connectors 753*a-d* by connecting each diffractor section to a shaft which is mounted in a hole in the peripheral connectors. The diffractor sections can thus rotate around an axis going through the holes of the peripheral connectors. The light beam (not shown) will hit the diffractor sections 707*a-d* from the bottom side and the diffract sections 707*a-d* will diffract the light beam in different directions at the top side. The center of the light beam goes through the center of the mounting bracket 749 and each diffractor section can thus rotate around an axis parallel to but displaced in relation to the central axis of the light beam. The actuators 719*a*-719*d* are respectively arranged on the radial protrusions 751*a-d* and respectively connected to diffractor sections 707*a-d* through respectively rotatable connectors 755*a-d*. The rotatable connectors enable rotation of the diffractor sections 707*a-d* around an axis which is perpendicular to the axis of rotation of the actuators. The rotatable connectors can for instance be embodied as flexible tubs, as springs or as knee-joints as known for mechanical engineering.

The top part of the illumination device can be covered by a top cover (not shown) which covers the areas between the diffractor sections 707*a-d* and thus prevents light from being emitted through the top side.

The present invention has been illustrated in view of a light diffractor comprising two or four diffractor sections. However, the skilled person realizes that, the present invention can be embodied with any number greater than two diffractor sections.

The invention claimed is:

1. A moving head light fixture comprising:
- a base;
- a yoke rotatably connected to said base;
- a head rotatably connected to said yoke, said head comprising:
  - at least one light source generating a light beam along a central axis, wherein at least a part of said light beam exits said head through a light beam diffractor, said light beam diffractor is arranged in front of said head,
  - wherein said light beam diffractor comprises:
    - a first diffractor section diffracting a first part of said light beam;
    - a second diffractor section diffracting a second part of said light beam;
    - wherein at least a part of said second part of said light beam is different from said first part of said light beam,
    - wherein said first diffractor section and said second diffractor section are rotatable in relation to said light beam and independently of each other wherein said first diffractor section is rotatable around a first axis, said first axis being substantially parallel with the central axis of said light beam; and said second diffractor section is rotatable around a second axis, said second axis being substantial parallel with the central axis of said light beam.

2. The moving head light fixture according to claim 1 wherein at least one of said first axis or said second axis is offset of said central axis.

3. The moving head light fixture according to claim 1 wherein a first actuator is adapted to rotate said first diffractor section around said first axis and a second actuator is adapted to rotate said second diffractor section around said second axis, and said first actuator and said second actuator are each independently controlled by at least one processor.

4. The moving head light fixture according to claim 1 wherein said first diffractor section and said second diffractor section are positioned in substantially the same distance from said light source.

5. The moving head light fixture according to claim 1 wherein said illumination device comprises a zoom lens positioned at least partially in said light beam, and between said light source and at least one of said diffractor sections.

6. The moving head light fixture according to claim 5 wherein said zoom lens is movable along said light beam.

7. The moving head light fixture according to claim 1 wherein at least one of said diffractor sections is circular and positioned in a bearing.

8. The moving head light fixture according to claim 1 wherein at least one of said diffractor sections is embodied as a cutout of a polymer Fresnel lens.

9. The moving head light fixture according to claim 1, wherein said light beam diffractor comprises a plurality of circular Fresnel zones, said plurality of circular Fresnel zones being centered at said central axis of said light beam and wherein said first diffracted section and said second diffraction section comprise a part of said circular Fresnel zones.

* * * * *